US007533465B1

(12) United States Patent
Frazer

(10) Patent No.: US 7,533,465 B1
(45) Date of Patent: May 19, 2009

(54) FOLDING KNIFE WITH FINGER GUARD

(75) Inventor: Spencer Frazer, Lynnwood, WA (US)

(73) Assignee: SOG Specialty Knives Inc., Lynnwood, WA (US)

( * ) Notice: Subject to any disclaimer, the term of this patent is extended or adjusted under 35 U.S.C. 154(b) by 21 days.

(21) Appl. No.: 11/339,227

(22) Filed: Jan. 24, 2006

(51) Int. Cl.
*B26B 29/02* (2006.01)

(52) U.S. Cl. ..... 30/155; 30/151; 30/153

(58) Field of Classification Search ..... 30/153, 30/155, 158, 160, 161, 2, 151, 283–286, 30/329, 340
See application file for complete search history.

(56) References Cited

U.S. PATENT DOCUMENTS 1,545,542 A * 7/1925 Albrecht et al. ..... 30/53
2,199,430 A * 5/1940 Greve ..... 30/160
2,316,246 A * 4/1943 Hyatt ..... 30/153
4,073,057 A * 2/1978 Gilbert ..... 30/153
4,802,279 A * 2/1989 Rowe ..... 30/155
5,331,741 A * 7/1994 Taylor, Jr. ..... 30/158
5,440,814 A * 8/1995 Hall et al. ..... 30/295
5,522,828 A * 6/1996 Malilay ..... 606/167
5,843,107 A * 12/1998 Landis et al. ..... 606/167
5,896,665 A * 4/1999 Harris ..... 30/160
6,170,158 B1 * 1/2001 Daily ..... 30/161
6,178,640 B1 * 1/2001 Votolato ..... 30/2
7,325,312 B1 * 2/2008 Janich ..... 30/161
2002/0088124 A1 * 7/2002 Ralph ..... 30/161

* cited by examiner

*Primary Examiner*—Maurina Rachuba
(74) *Attorney, Agent, or Firm*—Michael F. Hughes; Hughes Law Firm, PLLC

(57) ABSTRACT

A folding knife having a finger guard extension mounted to the handle portion that is adapted to be positioned in a stored position when the knife is in a closed orientation. The finger guard is adapted to be withdrawn from the handle in an extended position when the blade is in an open position.

28 Claims, 9 Drawing Sheets

FOLDING KNIFE WITH FINGER GUARD

BACKGROUND

Folding knives are common types of cutlery instruments which provide a handle for grasping a cutting implement and a sharp knife edge for cutting purposes. Folding knives have long been desirable for their inherent functionality of providing a shortened overall stored position where the blade is safely positioned inside a portion of the handle.

Lock-blade knives provide a certain amount of protection where one of a variety of locking type methods keeps the blade in the open position without (or at least limiting) the risk of having the blade close onto the fingers of the individual grasping the handle.

Fixed blade knives of course are well-known and are likely one of the earliest tools utilized by man in one form or another. Fixed blade knives have the advantage of essentially being a unitary tool with various extensions extending therefrom. Of course, various hand guards on fixed blade knives have been utilized in the prior art.

The sharp portion of a blade is potentially a liability for the handler of the instrument. Even with the most skilled blade handler, accidents can happen when the knife is utilized for any kind of cutting operation. Of course, there are various types of cutting strokes that can be engaged in when utilizing a knife. The sharp portion of a knife is often positioned against a material to be incised and a transverse downward thrust is a common stroke used to incise material. On occasion, a longitudinal motion of the knife can assist in the cutting process.

With regard to longitudinal force placed on a knife, in general, the handle of the knife is extended in the longitudinal direction (defined herein below). Given the ergonomics of the hand, the handle region generally fits along the phalanges 1-4 with the thumb wrapped therearound in a standard gripping action. Most common handles may have some contour, but by and large, any longitudinal force and in particular a longitudinal rearward force (defined further herein) is counteracted by frictional engagement between the hand of the knife handler and the surface of the handle region. Of course this frictional engagement is dependent upon the coefficient of friction of the two materials (the skin of the hand and the surface of the handle) as well as the normal force orthogonal to the various surfaces of the handle region which is dependent upon the grip of the knife handler.

These two variables can fluctuate widely when the knife is in operation in the field. For example, the coefficient of friction can alter with various materials interposed between the hand and the handle. Perspiration greatly effects the coefficient of friction, and material such as oil or perhaps certain gloves may make the knife handle more "slippery". Further, the grip strength can vary widely. Because static friction essentially prevents any motion between the handle and the hand, the knife handler may not know the correct grip strength to keep the knife intact within his hand. Further, because kinetic friction is less than static friction, once the knife begins to slip particularly in a dynamic action such as a thrusting action described below, the hand can potentially slip forward onto the sharp portion of the knife causing considerable damage to the fingers or palm of the knife handler.

Referring back to the types of motions, a force along the longitudinal direction of the knife is often desirable to assist in incising material. Further, most knives have a pointed region with a very small surface area. This pointed region can be utilized for puncturing holes in material. However, this forward thrust is counteracted by a certain amount of resistance depending upon how easily the material is cut. Further, the knife may have a certain amount of forward velocity which de-accelerates as the hand continues to move in this forward direction. This provides an environment which is somewhat risky where if the frictional forces between the hand and handle were to fail, the hand would be thrust forward over the sharp portion of the blade seriously injuring the knife handler. In any combat situation, such an injury can seriously jeopardize an operator and the mission.

Therefore, there is a need for providing the compact nature of the folding knife and providing a system for maintaining proper hand position on the handle portion.

DETAILED DESCRIPTION

Figure 1:
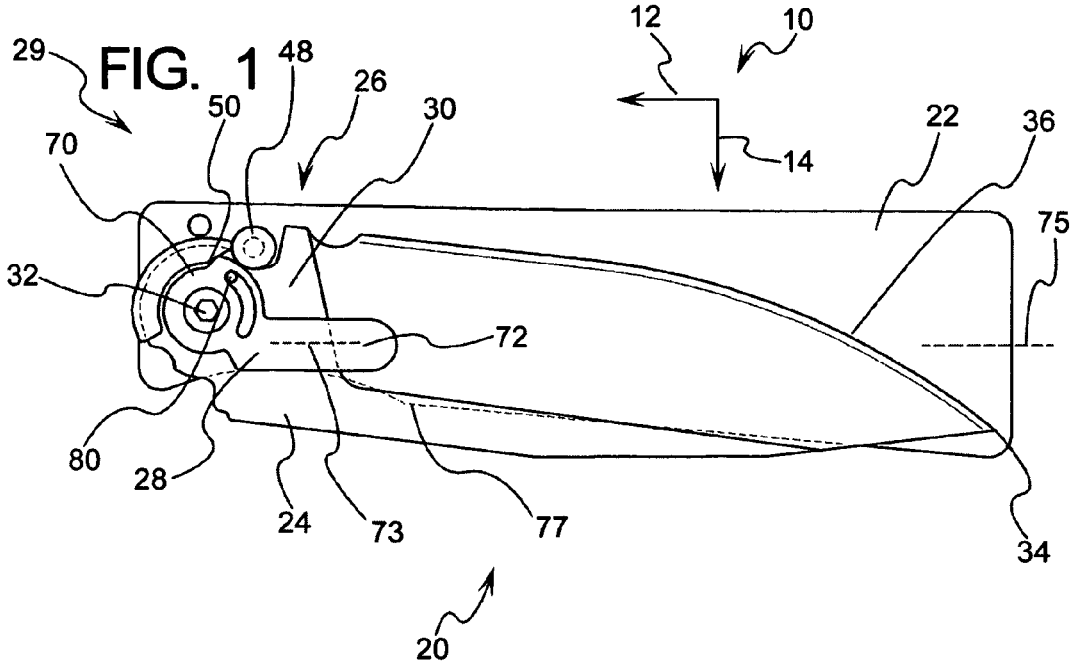
FIG. 1 shows a side view of an embodiment of a folding knife where the internal mechanisms are shown.

To aid in the description of the folding knife 20, as shown in FIG. 1, an axes system 10 is defined where the axis indicated at 12 is a longitudinal axis and pointed in the forward direction. The axis 14 is referred to as a transverse axis which is pointed in a downward direction. And further, an axis orthogonal or substantially orthogonal to the axes 12 and 14 is referred to as the lateral axis. It should be noted that the directions and axes set out general directions and for example the transverse axis is broadly defined as a general downward direction as shown in FIG. 1, not necessarily ninety degrees to the longitudinal axis 12.

As shown in FIG. 1, there is a knife 20 which in particular is a folding-style knife or an assisted opening style knife. In general, the knife (folding/collapsible knife) 20 comprises a handle region 22 and a blade 24. Positioned at the connection portion between the handle region 22 and the blade 24 is a lock assembly 26 and a finger guard 28. These portions will be described further herein below. The blade has a base region 30 and is pivotally attached at the pivot location 32.

Figure 2:
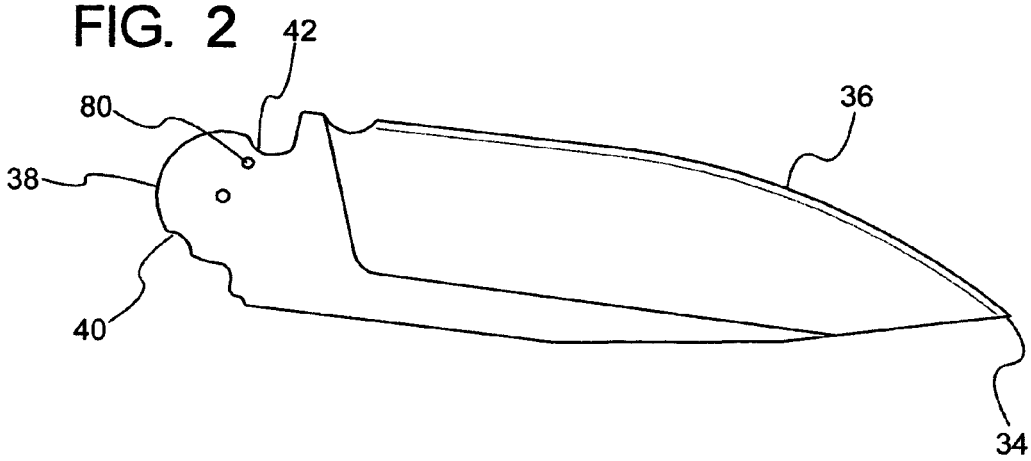
FIG. 2 shows a side view along the lateral axis of a folding blade.

The blade generally comprises a pointed portion 34 and a sharp portion 36. As shown in FIG. 2, located at the base portion is a base engagement surface 38.

In general, the base engagement surface 38 comprises a locked open surface 40 and a locked closed surface 42. In general, the locked open and locked closed surfaces are radially inward with respect to the surrounding base engagement surface portions. A plunger 48 is adapted to be positioned in the forward portion of the handle 22 as shown in FIG. 1. The plunger is a part of the lock assembly 26 and is adapted to cooperate with the locked closed surface 42 and locked open surface 40 (see FIG. 2). Essentially, the plunger comprises a base engaging surface 50 which in one form is cylindrical or partially cylindrical and is adapted to engage the locked surfaces 40 and 42 as shown in FIGS. 1 and 2. Further, an unlocked surface is positioned laterally adjacent to the base engaging surface 50 where the unlocked surface is radially inward to the center axis 54 of the plunger to allow the adjacent base engagement surface to the locked open and closed surfaces 40 and 42 to freely pass thereby. Of course a variety of locking mechanisms can be utilized and the locking mechanisms are optional.

Figure 3:
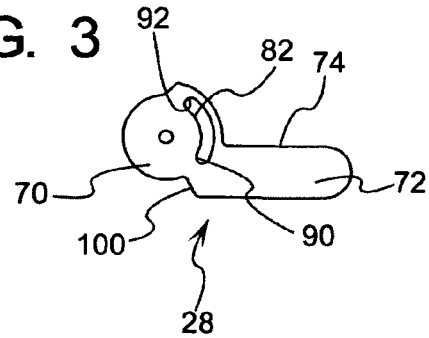
FIG. 3 shows a side view of a finger guard.

With the foregoing description in mind, there will now be a detailed discussion of the finger guard 28 with initial reference back to FIG. 1. In general, the finger guard 28 in one form is pivotally attached at the pivot location 32. The finger guard 28 has a base portion 70 and an extension portion 72. Located in the extension portion is a trailing surface or otherwise referred to as a longitudinally rearward surface 74. An actuating system 29 is defined as the various mechanisms shown herein to reposition the finger guard from the retained position as shown in FIGS. 1, 4, 5A, 6, 9, 10, 14, 15A, 16, and 19 to an extended position as shown in FIGS. 5, 8, 13, 15, 15B, 18, and 21. As shown in FIG. 3, positioned on the base portion 70 is a surface defining a range slot 82. The lateral extension 80 (see FIG. 1) is adapted to be fitted within the surface defining a range slot 82 on the base region 70 of the finger guard 28 (see FIG. 4). As shown in FIG. 1, the finger guard 28 has a central axis 73 on the extension portion 72 where the central axis 73 is retained in the lateral direction within the handle region 22. In other words, the central axis 73 is positioned within or behind the lower perimeter region of the handle region 22. This is the case with all of the embodiments shown herein as the finger guard is in the retained position. In the broader scope, for example, a very thin finger guard in the lateral direction may be utilized where only the trailing edge is retained behind the lateral profile 77 of the handle region 22. The handle region has a center axis 75 that generally runs the length of the handle region 22. The center axis 75 is substantially orthogonal to the axis 73 as shown in FIG. 5 when the finger guard is in the extended position. Substantially orthogonal is defined broadly and is not strictly defined as directly orthogonal but rather any offset angle that allows the finger guard to be extended with respect to the handle where the trailing surface of the finger guard at least has the capability to engage the hand of the knife handler.

Figure 4:
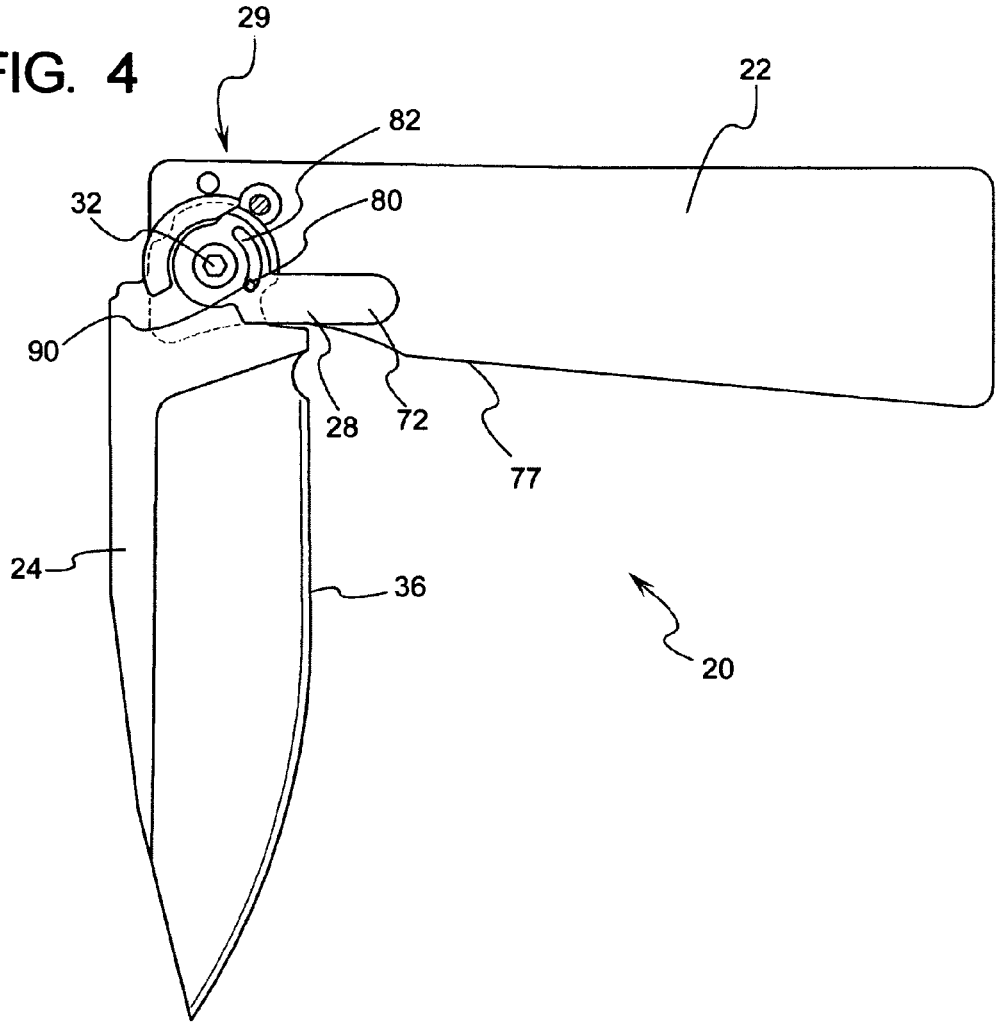
FIG. 4 shows a side view of a folding knife with the blade partially extended.
Figure 5:
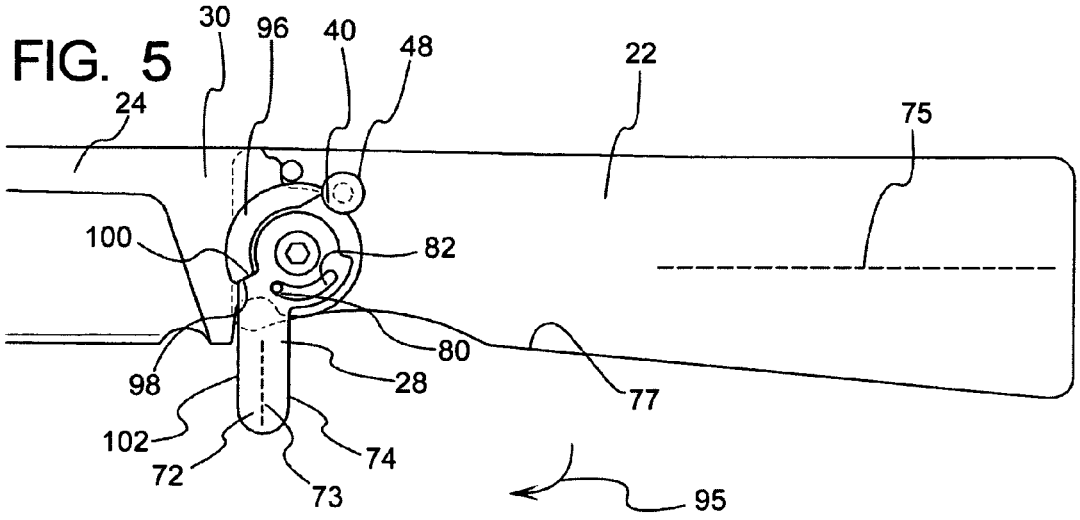
FIG. 5 shows a side view of a knife with the blade extended and the finger guard in an open orientation.

As shown in FIG. 4, it can be appreciated how the blade is positioned in an intermediate position whereby the extension 80 is just beginning to engage the forward portion 90 of the range slot 82 (see FIG. 3); however, the finger guard is in still in a retained position. Now referring to FIG. 5, it can be appreciated how the extension 80 has biased the finger guard 28 into an open position where the rotation of the blade 24 has biased the finger guard 28 to an extended position which is essentially half of the total rotation in substance of the blade portion 24 with respect to the handle region 22. In this orientation, the longitudinally rearward surface 94 is extended and adapted to have pressure applied thereto. As described above, such pressure applied to the longitudinally rearward surface 74 can be of the forefinger of the individual handling the knife.

It should be noted that the finger guard 28 has limited rotation and will not rotate further in the positive direction as indicated by arrow 95 in FIG. 5. The guard stop 96 is fixedly attached the handle 22. The stop surface 98 is adapted to engage the guard stop surface 100 which is shown in FIG. 3. Therefore, if a positive torque is applied to the finger guard 28 which presumably would be caused in operation by a forward thrust acting upon the longitudinally rearward surface 94, the torque is addressed by the guard stop 96. Further, if the finger guard 28 were to strike an object particularly in the longitudinally forward surface 102, the rearward rotation is counteracted between the forward portion 90 of the range slot 82. Further, the torque would be transferred to blade 24 (more particularly in the base region 30) and such torque is thereby transferred to the locked open surface 40 to the plunger 48. Therefore, it can be appreciated that in one embodiment, the extension 80 not only biases the finger guard 28 open but further can maintain it in an open orientation.

Figure 5A:
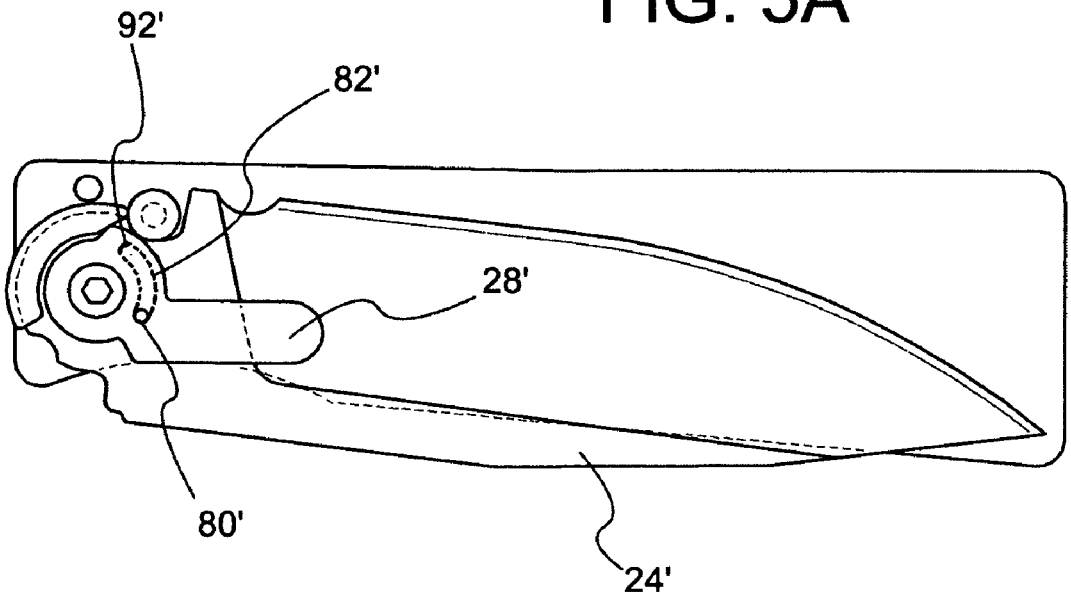

It should be noted by way of example in FIG. 5A, that in another form of an actuating mechanism 29' the positional slot 82' and extension 80 can be inverted from the blade to the finger guard and vice versa. In this form an extension 80' in the finger guard 28' engages a slot 82' in the blade 24' where a rearward portion 92' of the slot 82' in the blade 24' would engage the lateral extension 80' of the finger guard 28' to bias the finger guard 28' open. When the finger guard is extended in the open orientation it is substantially transverse to the blade and handle regions which is broadly defined as not necessarily orthogonal thereto but not collinear to a central axis of either the blade or the handle regions.

Figure 6:
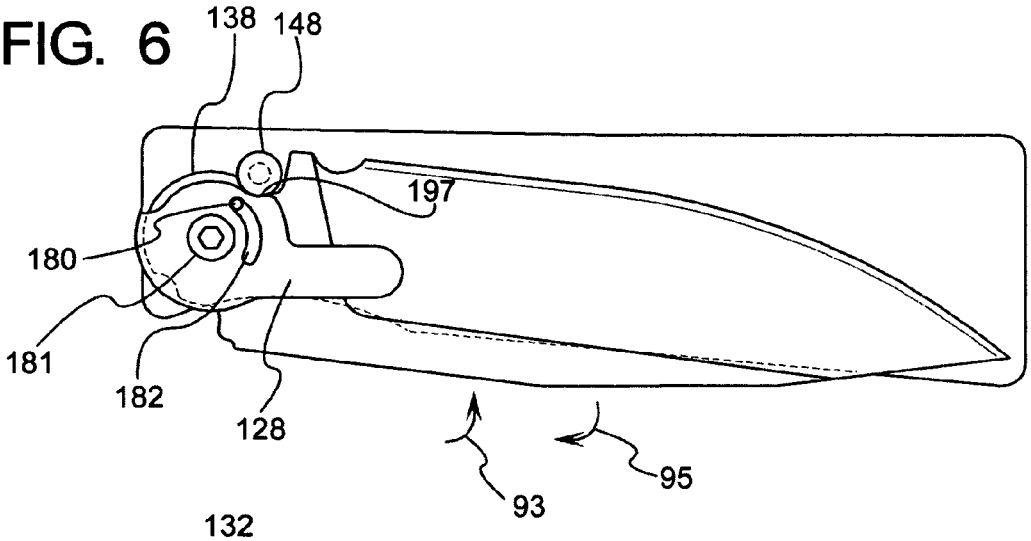
FIG. 6 shows another embodiment of a finger guard system.
Figure 7:
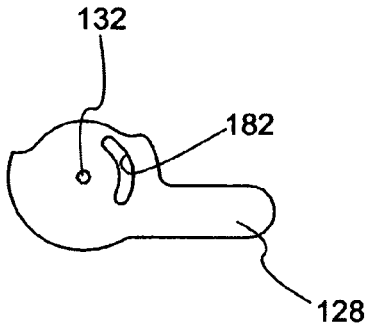
FIG. 7 shows the finger guard in the second embodiment.
Figure 8:
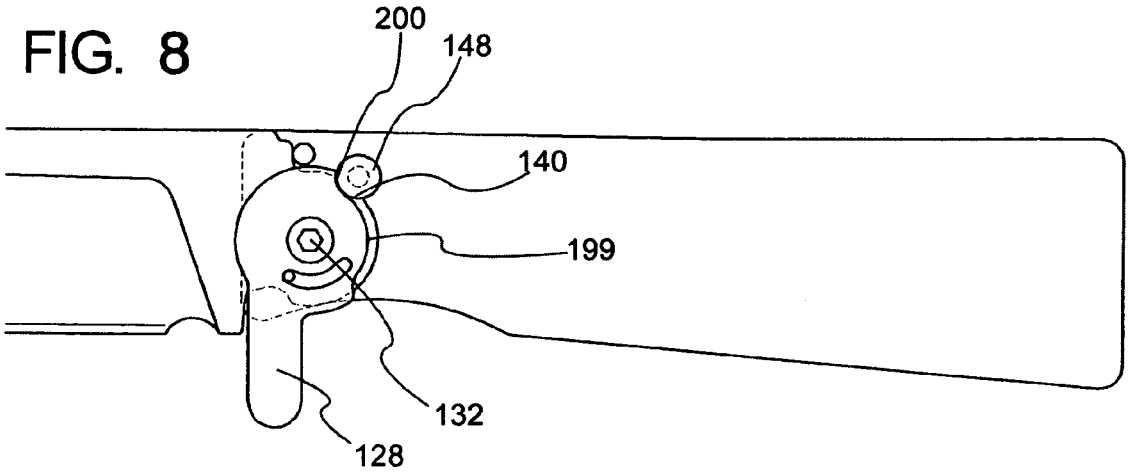
FIG. 8 shows the second embodiment with the knife in an open orientation.

Now referring to FIGS. 6-8, there is an embodiment having slight variations from the embodiment as shown in FIGS. 1-5. Referring to FIG. 7, it can be appreciated that the finger guard 128 has a positioning slot 180 which is similar to that as described above. Further, the finger guard is adapted to rotate about the pivot location 132; however, as described herein in the broader scope the finger guard could of course rotate about other axes which are not concentric and collinear to the axis of rotation of the blade. In FIG. 6 the plunger 148 is shown which is of course only one form of a locking mechanism. Of course, the locked closed position is entirely optional and in some embodiments as described below, the base engagement surface can have various radial widths from the center of rotation based upon rotation values. In other words, in a closed position with a locking mechanism more akin to that shown in FIG. 9, there is a biasing of the blade to be closed. In some forms, this can be accomplished by a frustoconical shaped plunger 148. At any rate, as shown in FIG. 8, the plunger 148 is engaged to the locked open surface 140. The plunger 148 is further engaged upon the guard stop surface 200 which extends radially outwardly from the pivot portion 132 with respect to the glide surface 199. In a like manner, as shown in FIG. 6, the closed rotation surface 197 prevents negative rotation as indicated by the arrow 93 in FIG. 6 where the amount of upward rotation of the finger guard 128 is limited. With proper tolerance fits, the finger guard 128 will be limited in the amount of loose rotation whereby the extension 180 is biasing the finger guard in a negative direction indicated at 93 about the lateral axis. In a counteracting moment, the plunger 148 is biasing the finger guard in a positive rotation direction as indicated by 95 in FIG. 6. It should be noted that a spring device can be place at location 181 to provide a torque to the blade to assist the opening thereof.

FIGS. 9-13 shows yet another embodiment. In this form, the locking mechanism is illustrated by way of a lock back-type system. For purposes of illustration, two types of variations of this embodiment are shown where of course it can be appreciated that there are many types of variations which are all covered within the broad scope of the claims herein below. As shown in FIG. 9, the knife 220 again comprises a blade portion 224 and a handle portion 222. The locking assembly 226 essentially operates on similar principles where engagement of various surfaces provide a desirable lock-like feature of the knife to position the blade with respect to the handle in a variety of desirable orientations to fixedly and temporarily maintain such positions.

Figure 10:
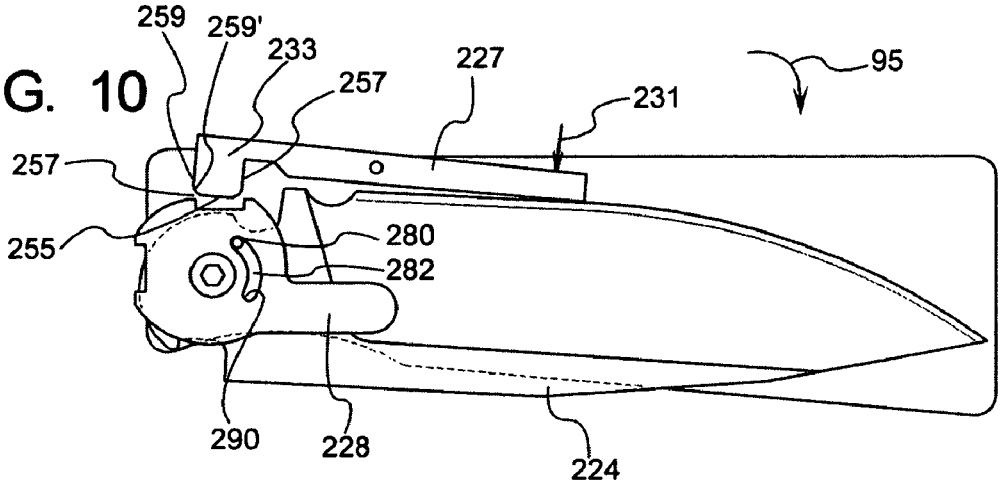
FIG. 10 shows the lock-back latch of the locking system pressed inwardly.
Figure 11:
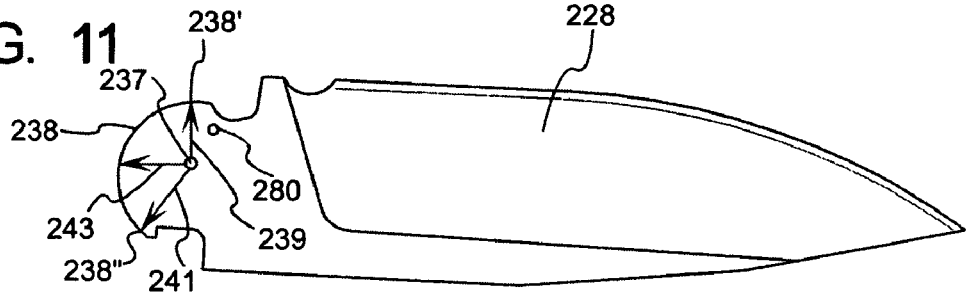
FIG. 11 shows the blade of the third embodiment.

In this form, the locked mechanism 226 is a derivative of a conventional lock back system where essentially, the lever bar 227 is pivotally mounted at point 229. By placing a positive torque thereon, which is illustrated in FIG. 10 by vector 231, the head 233 disengages from the various locking surfaces of the finger guard 228 and the blade 224. The head 233 comprises a head inward surface 255, a longitudinally rearward surface 257 and a longitudinally forward surface 259. The longitudinally forward surface and a longitudinally rearward surface 259 and 257 operate cooperatively to provide a locking system described herein. FIG. 10 schematically shows the action of the lever 227. It should be noted, however, which would be appreciated further herein, that such action is not categorically necessary for opening the knife. However this positive rotation of the lever 227 as applied in FIG. 13 would allow the knife to be closed. As shown in FIG. 11, the base engagement surface 238 varies in its radial distance from the pivot portion 232. More particularly, the radial distance as indicated near the closed position at 239 increases as it rotates to the open position at 241. Referring back to FIG. 10, in one form of operation, the lever 227 can rotate in the positive direction as shown by way of a force applied indicated by vector 231. This of course would allow for a little less frictional engagement of the head inward surface 255.

Figure 9:
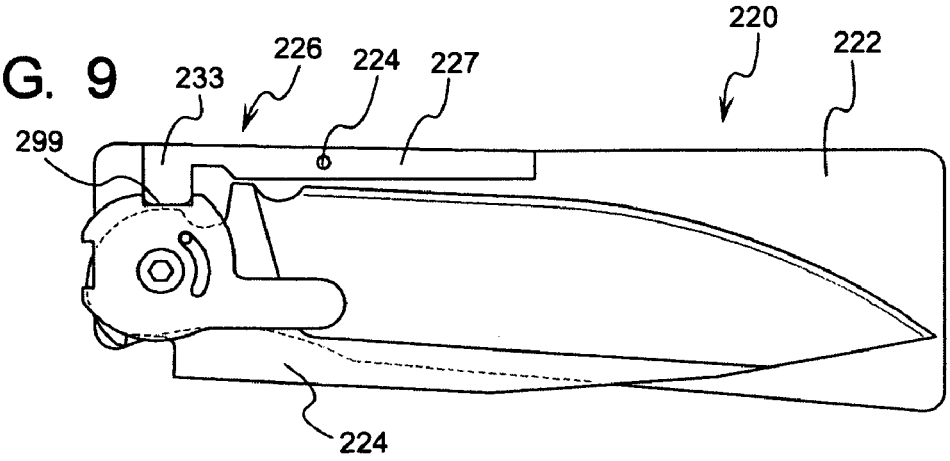
FIG. 9 shows another embodiment with a different type of locking mechanism conventionally known as a lock-back system.
Figure 12A:
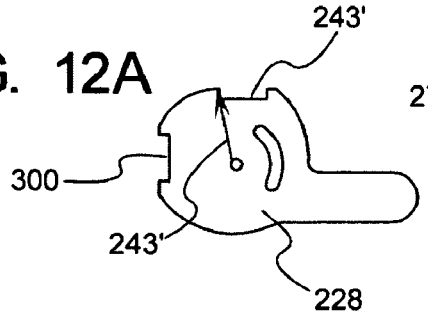
FIG. 12A shows one form of a finger guard for the third embodiment.
Figure 12B:
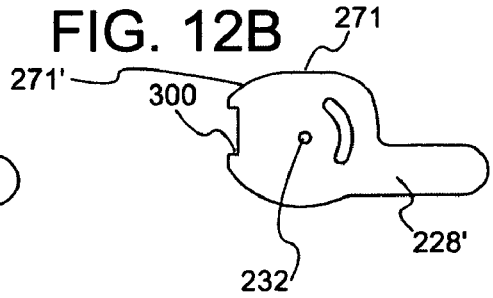
FIG. 12B shows another variation of the finger guard.
Figure 13:
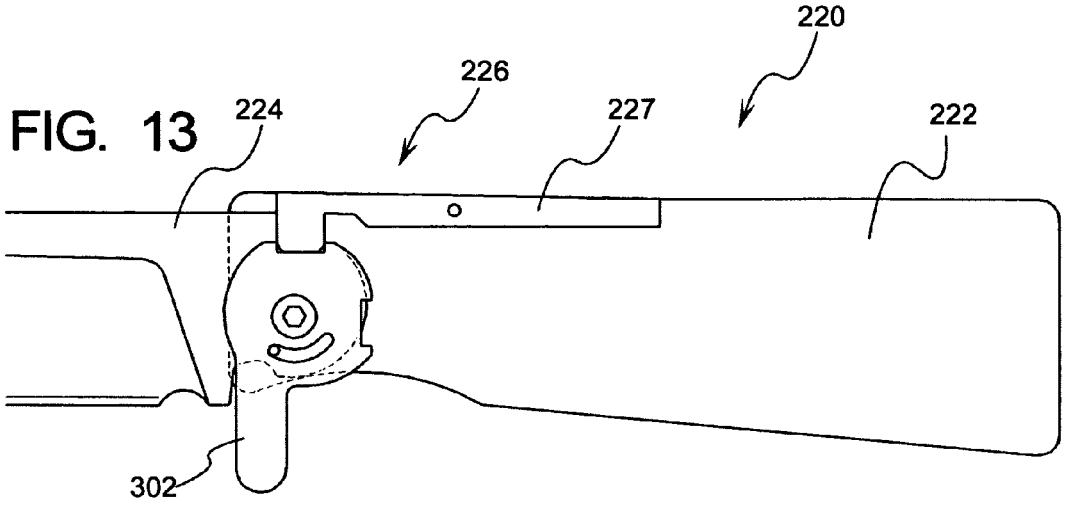
FIG. 13 shows the third embodiment where the blade is in an open orientation and the finger guard is extended.

As shown in FIG. 13, when the blade 224 is extended, the locking surfaces 257 and 259 are adapted to engage the locking surface 300 of the finger guard 228 as shown in FIG. 12A as well as FIG. 12B. Referring back to FIG. 10, it should be noted that when the lever 227 is spring-loaded to an orientation as shown in FIG. 9, the locked closed surface 299 is in engagement with the head 233. However, instead of manipulating the lever 227, it can be appreciated that as the blade 228 rotates in the positive direction, the increased radius of the base engagement surface 238 going from the orientation indicated at 239 to the distance indicated at 241 roughly, biases the lever 227 in the clockwise direction or positive rotation direction indicated at 95 in FIG. 10. Therefore, the arrangement can be such that when the extension 280 is about to become in contact with the forward portion 290 of the range slot 282, the radial distance of the base engagement surface 238 generally at the position to 237 (see FIG. 11) can be equal to that or at least partially equal to the distance indicated at 243' in FIG. 12A. Alternately, if the distance 243 is slightly less than the distance 243' then it should be at least great enough to where the edge portion indicated at 257 is at a proper angle with respect to the rounded portion 259' of the head 233 so the finger guard 228 can begin to rotate in the positive direction. Alternatively, as shown in FIG. 12B, the finger guard 228 can be arranged in a manner where the surface 271 is substantially in the same plan as the base engagement surface portion 238' when the finger guard 228' and the blade 228 are concentrically positioned about the rotation points 232. The portion 271' as shown in FIG. 12A is radially outward from the pivot point 232 the proximate same distance as the surface portion 238" as shown in FIG. 11 on the blade 228. Of course these distances can vary and be arranged for desirable embodiments regarding the timing of having the blade and the finger guard being opened.

It should be noted that as shown in FIG. 13, when the locking mechanism 226 is disengaged, any pressure applied to the longitudinally forward surface 302 will rotate the blade 224 towards a closed position.

Figure 14:
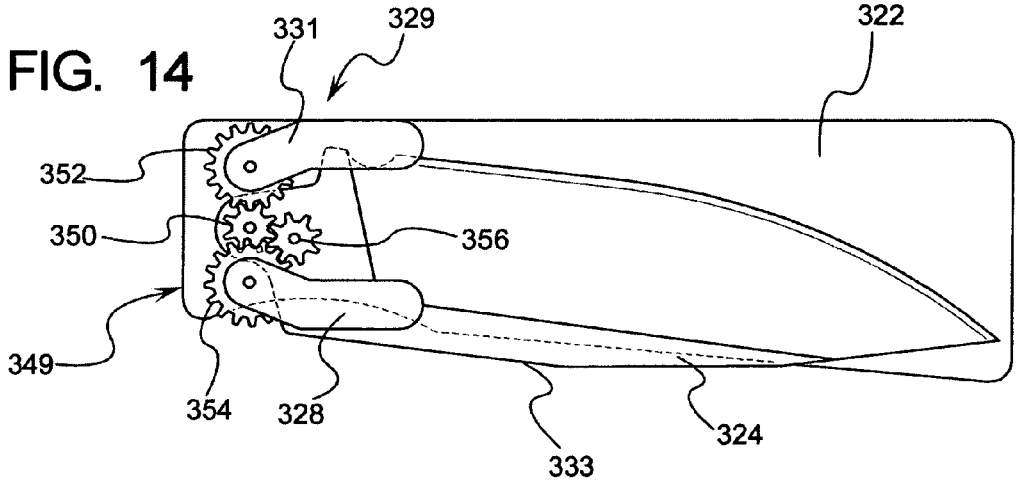
FIG. 14 shows another embodiment with a gearing like mechanism where an internal gear is fixedly attached to the blade and an intermediate gear is in communication with the lower finger guard which is laterally offset from the center gear and the center gear is in direct mechanical communication with the upper finger guard.

As shown in FIG. 14, there is another embodiment where the finger guard extraction/actuating system is shown in another form indicated at 329. In this embodiment, there is again a blade 324 and a handle region 322. As shown in the left-hand portion of FIGS. 14 and 15, the actuating system 329 is another finger guard extraction type system where in one form comprises a gear system 349 where the gear 350 is fixedly attached to the blade 324. The outer teeth of the gear are in engagement with the gear 352, which is rigidly attached to the upper finger guard 329. The lower finger guard 328 is rigidly attached to the gear 354. The intermediate gear 356 is in engagement with the center gear 350 and the gear 354. In one form, the gears 350 and 354 are offset in the lateral direction and the gear 356 is wide enough in the lateral direction to engage the teeth of both of these gears. Of course, any number of intermediate gears can be employed to accomplish the desired amount and direction of rotation of the finger guard(s). The contour of the blade 333 defines the side profile of the knife where as shown in FIG. 14 the finger guard is positioned above the contour 333 in the transverse direction while the knife is in a closed orientation.

Figure 15:
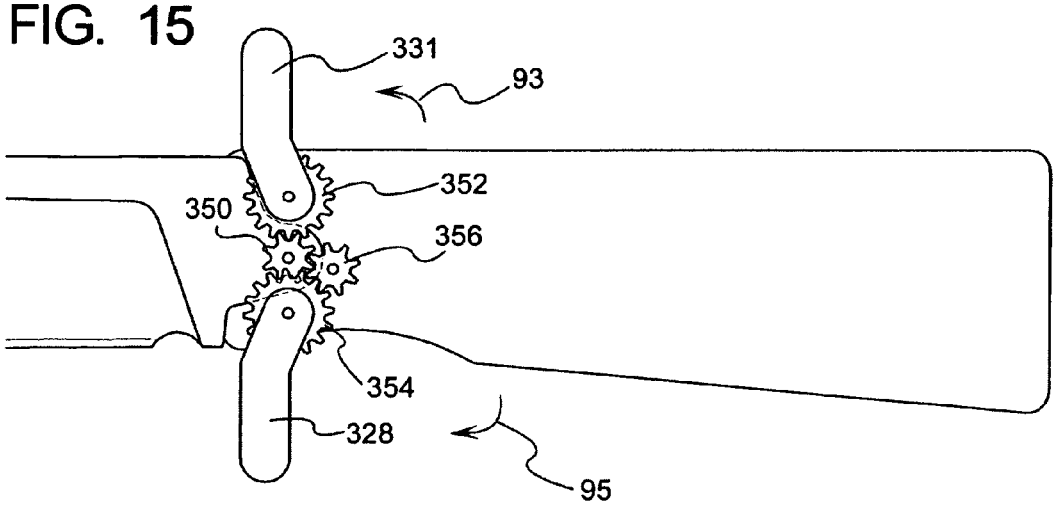
FIG. 15 shows the second embodiment where the finger guards are extended in an open orientation.

As shown in FIG. 15, as the knife blade rotates in the positive direction indicated at 95 in FIG. 15, the center gear rotates in the positive direction as well which essentially causes the gear 356 to rotate in the opposed direction. This rotation rotates the lower finger guard 328 in the positive direction. The upper finger guard 331 is in direct gearing engagement with the center gear 350. Therefore, as the center gear rotates in the positive direction as indicated by the arrow 95, the upper finger guard 331 rotates in the negative direction indicated at arrow 93 to the open position as shown in FIG. 15. Of course, the amount of rotation of the blade and more specifically the center gear 350 correlates to the amount of rotation of the finger guards 328 and 331, depending upon the number of cogs in the gear. In one form, the gear ratio between the smaller gears 350 and 356 and the gears 354 and 352 is a two to one ratio so the finger guards rotate one half the amount of the blade. Of course this ratio can be altered whereby say for example a 19 to 16 ratio would allow slightly more rotation of the finger guards to a more forward orientation. Alternatively, a smaller ratio say for example 7 to 16 would allow less rotation of the finger guards if that is so desired in certain situations and designs. Of course a larger gear ratio would allow for greater amount of rotation if so desired.

Figure 15B:
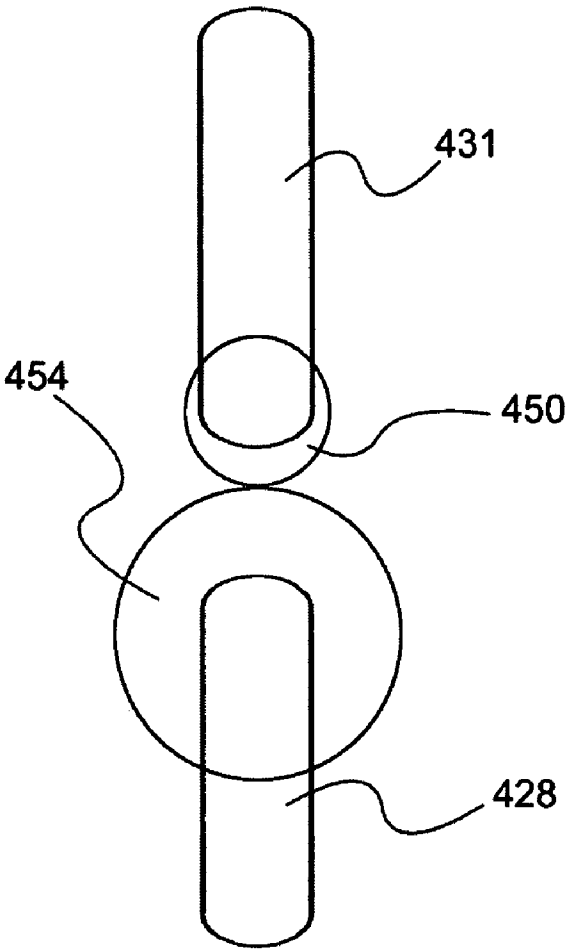
FIGS. 15A and 15B show another highly schematic variation of the previous embodiment where the upper smaller gear which is schematically shown in the circle is attached to the blade and when the blade rotates approximately 90° to the orientation as shown in FIG. 15B, both finger guards are extended, where it should be noted that in this version, both finger guards rotates in the positive direction as defined.
Figure 15A:
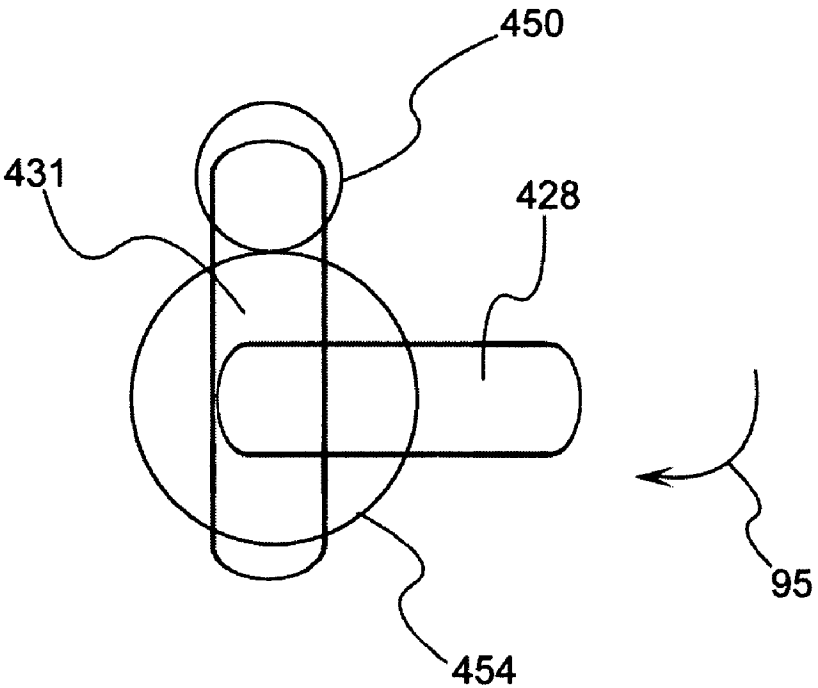

Further, in another form as shown highly schematically in FIGS. 15A and 15B, an embodiment shown by the circular gears would be such where the center gear 450 has say for example a ratio of two to one with respect to the lower gear 454. The center gear 450 is attached to the blade and when the blade rotates, for example 180°, the lower finger guard 428 will rotate one half that and the upper finger guard 431 would rotate 180° to the open orientation as shown in FIG. 15B. Of course, as recited above, the amount of rotation can occur in a variety of formats. The embodiments as shown in FIGS. 15A and 15B are illustrative of how the finger guard can be deployed when they both rotate in the positive direction as indicated by arrow 95. In one form, this rotation scheme is desirable because the upper finger guard 429 does not rotate in the negative direction which may interfere with the grip of the individual grasping the handle of the knife.

Figure 16:
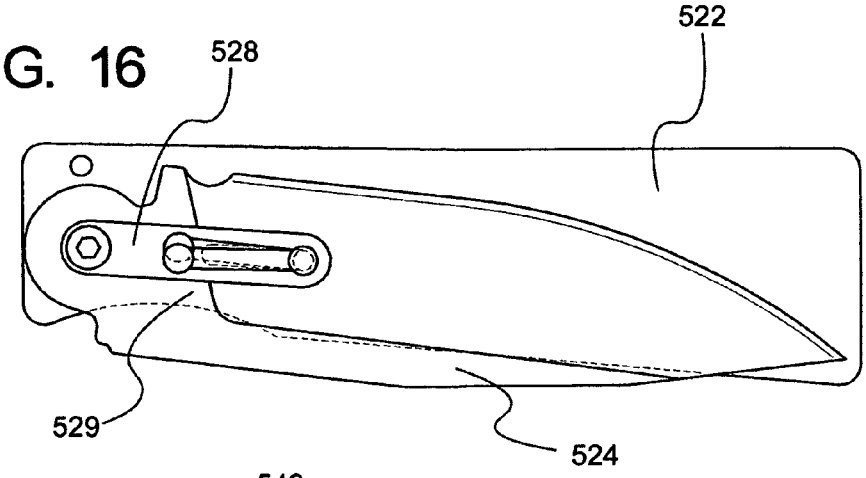
FIG. 16 shows a side view of yet another embodiment where the actuating system consists of a linkage-like assembly.
Figure 17:
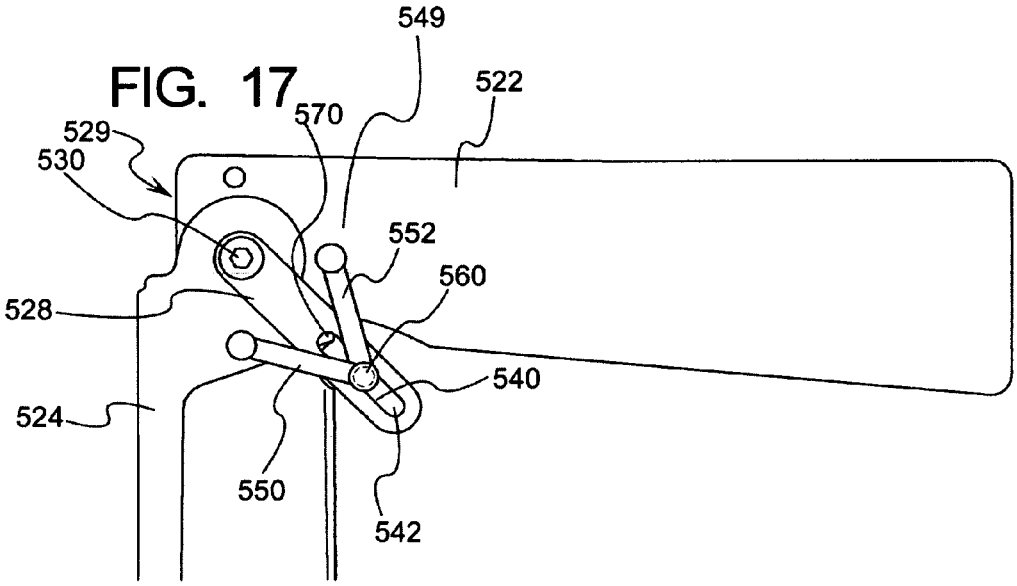
FIG. 17 shows a folding knife in a transitional view where the linkage-like actuating system is repositioning the finger guard with respect to the blade portion.
Figure 18:
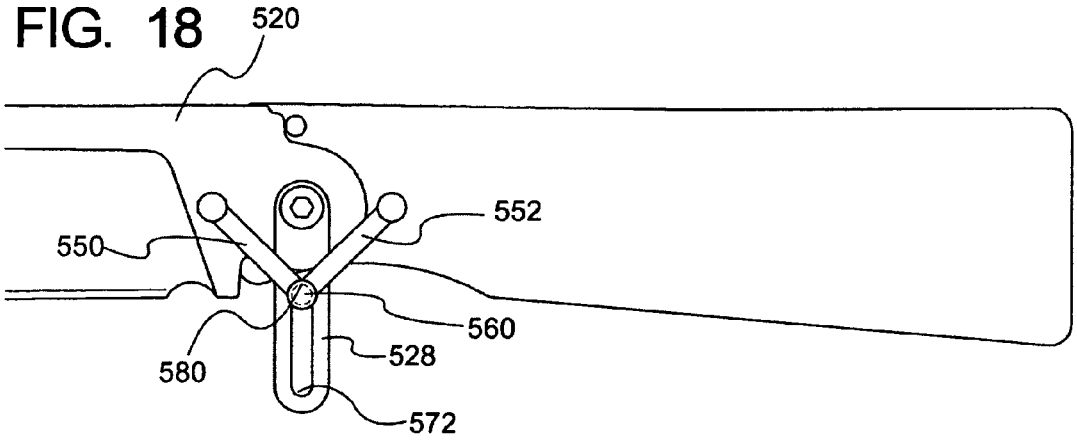
FIG. 18 shows a side view of the internal portion of the knife where the finger guard is extended and the knife is in an open orientation.

As shown in FIG. 16, there is another embodiment where the finger guard member 528 is repositioned by way of another actuating system 529 by way of a linkage mechanism 548. As shown in FIG. 17, the finger guard 528 is pivotally attached at the pivot location 530. In one form, this pivot location 530 coincides in location about the lateral axis with the pivot attachment of the blade 524. The finger guard 528 has a surface 540 defining the slot 542. The actuating mechanism in this embodiment is a linkage assembly/mechanism 549 that is comprised of the first and second positioning arms 550 and 552 that are pivotally attached to the blade and the handle portions 524 and 522 respectively. Further, the first and second link members are pivotally attached at the pivot location 560. The pivot location 560 has an extension or is otherwise fixedly attached to move within the slot 542. As shown in FIG. 18, as the blade 524 is in the open position, it exerts a force upon the first link member 550 during the transition, as shown in FIG. 17. This action pulls the finger guard 528 in to an extended position. The first and second members 550 and 552 as well as the portions of the blade 524 and the handle 522 comprise a four-bar linkage to control the movement position and orientation of the pivot location 560. The finger guard 528 further comprises inner and outer extreme portions within the slot 542. The inner extreme portion as shown in FIG. 17 is indicated at 570 and as shown in FIG. 18, the outer extreme portion is 572. These portions can coexist with the maximum positions of the pivot location 560 in the closed orientation as shown in FIG. 16 and in the fully open orientation in FIG. 18. Although these maximum locations 570 and 572 need not exactly be orientated adjacent to the pivot location 560 in the open and closed locations, it can be good in situations where it can add extra rigidity such as in the open position where the inward surface 580 is in engagement with the inner extreme portion 570 (see FIG. 17). Of course the finger guard 528 could be utilized in combination with gears similar to that as shown in FIGS. 14 and 15 as well as 15A and 15B to operate a second finger guard.

Figure 19:
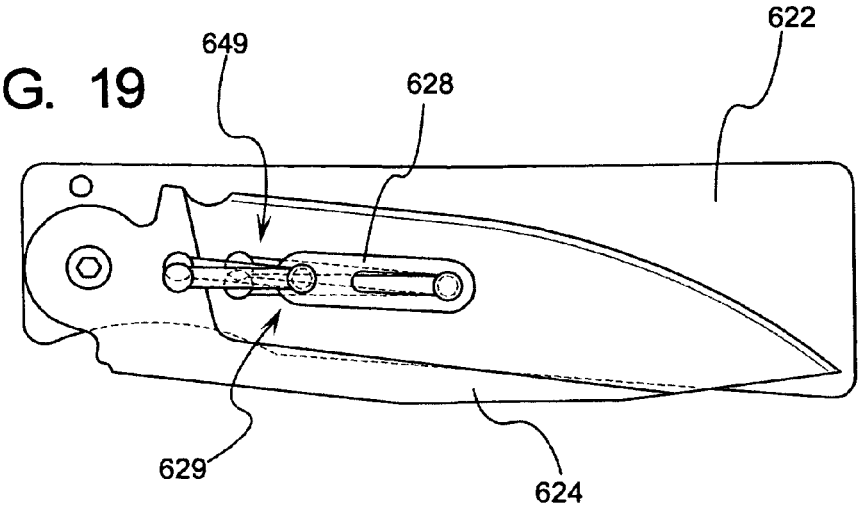
FIG. 19 shows yet another embodiment of an actuating system where in this variant, the finger guard is not directly pivotally attached to the knife or the handle.
Figure 20:
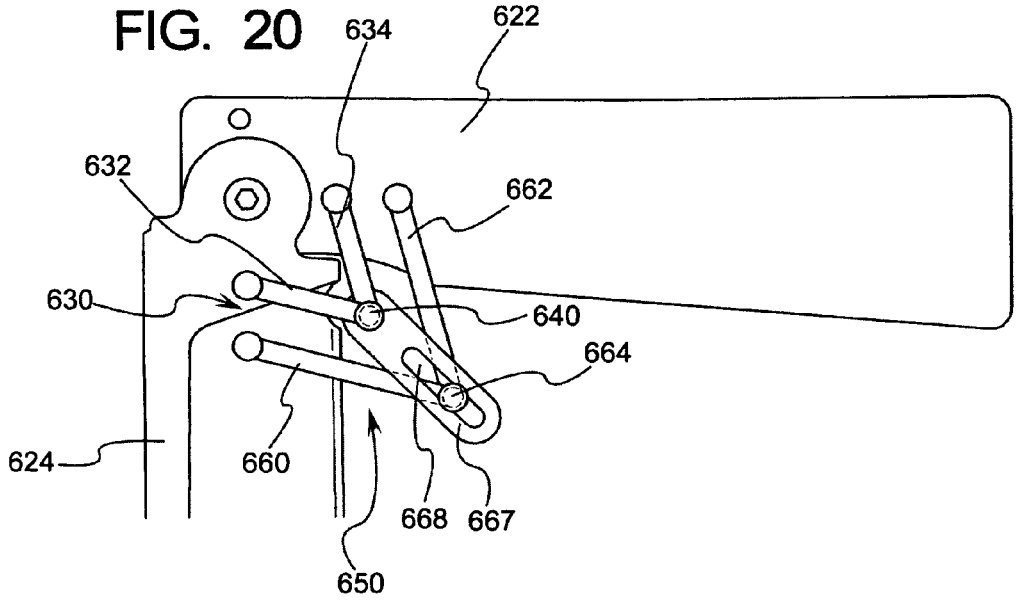
FIG. 20 shows an immediate view of the finger guard where the actuating system is shown in a schematic nature to illustrate, in this case, two sets of linkages that are utilized in this form as one example of another actuating type system where as clearly shown in this intermediate position, the finger guard is not directly attached, but in this form, the first and second linkage assemblies provide positional arrangement and connection of the finger guard to the blade and handle portions.
Figure 21:
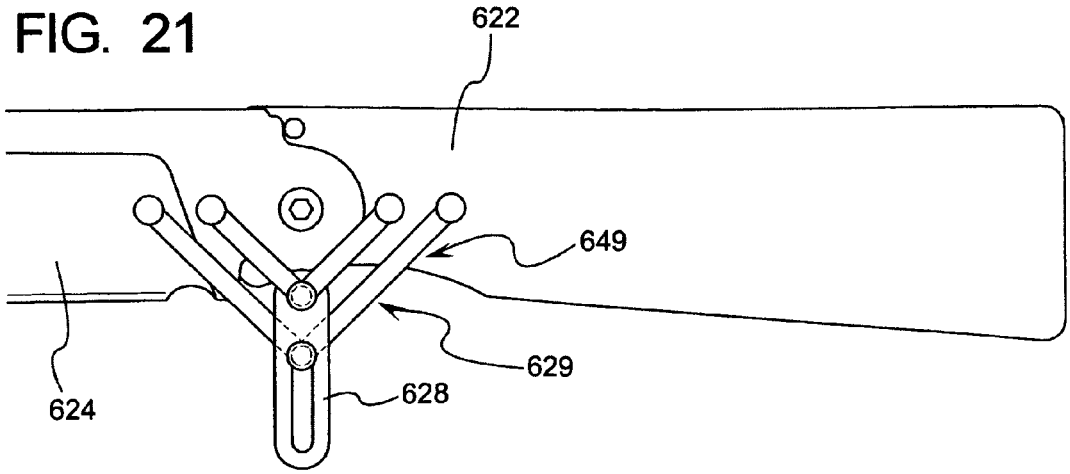
FIG. 21 shows the final embodiment with the finger guard in an extended position.

As shown in FIG. 19, there is yet another embodiment similar to the previous embodiment. In this embodiment, the finger guard as shown at 628 is essentially attached by way of two four-bar linkage systems to comprise the actuating system 629. As shown in FIG. 20, the first linkage set 630 comprises the first and second linkages 632 and 634. These linkages are pivotally attached to the blade 624 and the handle 622 respectively. Further, the linkages are pivotally attached at the pivot attachment portion 640. The second set of linkages 650 are comprised of first and second positioning linkages which are also pivotally attached to the blade pivot linkages 660 and 662 which are also pivotally attached to the blade 624 and the handle 622 respectively. The linkages 660 and 662 are pivotally attached at the pivot attachment location indicated at 664 which is adapted to be slidably attached within the surface 667 defining the slot 668. As shown in FIG. 21, the orientation of the linkages is such that the finger guard 628 is not necessarily directly pivotally attached to the handle 622 or the blade 624. In this form, the two sets of four-bar linkages are comprised of the linkage sets 630 in conjunction with the handle and the blade as well as the second set of linkages 657.

Of course, it can be appreciated that various further modifications and alterations into the numerous embodiments as shown above can be shown without departing from the spirit and scope of the invention as broadly defined and recited in the claims below. Further, various components as described above can be combined and interchanged amongst the various embodiments to produce further additional derivatives of the embodiments. For example, the actuating systems as shown above which are adapted to reposition the finger guard in a retained position where the finger guard is substantially behind the profile of the handle and/or blade to an extended position in a variety of methods whereby the actuating system is defined broadly for any variation thereof to accomplish that operative ability.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicant's general concept.

I claim:

1. A folding knife having a longitudinal and transverse axes, the folding knife comprising:

a) a handle region which comprises a lateral profile taken along the lateral direction, b) a finger guard movably attached to the handle and operatively configured to rotate about a lateral axis from a retained position to an extended position substantially in the transverse direction, c) a blade pivotally attached to the handle region and adapted to be repositioned from a closed orientation to an open orientation, d) whereas the finger guard is positioned substantially behind the lateral profile of the handle region in a retained position when the blade is in a closed orientation and an actuating system repositions the finger guard to an extended position with respect to the motion of the blade from a closed orientation to an open orientation so the finger guard in the extended position is substantially in the transverse direction when the blade is fully extended with respect to the handle region.

2. The folding knife as recited in claim 1 where an extension positioned on the blade is operatively configured to fit within a range slot of the finger guard whereby the extension engages a forward portion of the range slot to reposition the finger guard from a retained position to an extended position.

3. The folding knife as recited in claim 1 where the finger guard has an extension that is positionally engaged within a range slot of the blade whereby the extension is adapted to reposition with respect to the blade to reposition the finger extension from a retained position to an extended position when the blade repositions from a closed orientation to an open orientation respectively.

4. The folding knife as recited in claim 1 where the finger guard has a trailing edge surface that is retained behind the lower portion of the lateral profile when the finger guard is in a retained position.

5. The folding knife as recited in claim 4 where the blade portion and the finger guard are pivotally attached to the handle region about a common lateral axis.

6. The folding knife as recited in claim 1 where the finger guard is pivotally attached to the handle where the actuating system is comprised of a first gear that is gearingly attached to a knife gear by way of an intermediate gear, whereby the first gear, the knife gear and intermediate gear collectively operate to reposition the finger guard from a retained position while the blade is in a closed orientation to an extended position while the blade is in an open orientation.

7. The folding knife as recited in claim 1 where the actuating system is comprised of a double four-bar linkage assembly whereby first and second linkages are pivotally attached to the knife portion region and the handle region and further pivotally attached to an inward portion of the finger guard, a pin attached to the knife region and the handle region and further pivotally attached to one another at a pivot attachment location which is adapted to be slidely attached within a slot of the finger guard.

8. A folding knife comprising:

a) a handle region having an inner surface defining an elongated slot, the handle region having a forward region and a center axis, b) a blade pivotally attached to the forward portion of the handle region, c) a finger guard rotatably mounted to the forward portion of the handle region, the finger guard being operatively connected to the blade whereby an actuating means repositions the finger guard as the blade repositions from a closed position to an open position and the actuating means maintains the finger guard to a substantially fixed position substantially transverse to the center axis of the handle region when the blade is in the open position.

9. The folding knife as recited in claim 8 where the blade has a locked closed surface that is adapted to engage a plunger positioned in the forward portion of the handle whereas when the plunger is positioned in a laterally inward position, an unlocked surface ceases engagement of the locked closed surface of the blade, allowing the blade to open.

10. The folding knife as recited in claim 9 where the base portion of the blade further provides a surface having a locked open surface having a radially inward indentation with respect to the immediately surrounding tangential portions of the surface, where the locked open surface is adapted to engage a base engaging portion of the plunger to maintain the knife in the locked open position.

11. The folding knife as recited in claim 10 where a spring device has a first end in forceful communication with the handle and a second end in forceful communication with the knife where the spring is adapted to rotate the knife in a positive rotation.

12. A folding knife comprising:

a) a handle region having a forward portion and a lower perimeter region and a lateral axis, b) a blade pivotally attached at the forward portion of the handle and adapted to be positioned in a closed orientation and an open orientation, c) an extractable finger guard positioned on the forward portion of the handle and pivotally attached to the folding knife so the finger guard is orientated in a closed position when the blade is in a closed orientation where a trailing edge portion of the extractable finger guard is positioned inward from the lower perimeter region of the handle region, d) an actuating system operatively attached to the handle region, the blade is operatively configured to reposition the finger guard to extend in a transverse direction when the blade is in an open orientation.

13. The folding knife as recited in claim 12 where the actuating system comprises an extension on the blade in the lateral direction that is in engagement with a surface defining a positioning slot within the finger guard where the extension is adapted to engage a forward portion of the slot to reposition the finger guard from the closed position to an open position.

14. The folding knife as recited in claim 12 where the actuating system is comprised of an extension on the finger guard in the lateral direction which engages a positioning slot defined by a surface on the blade.

15. The folding knife as recited in claim 12 where the extractable finger guard is pivotally attached at a location that is collinear with the portion of the blade pivotally attached to the handle region.

16. The folding knife as recited in claim 15 whereby a linkage mechanism comprising first and second linkage members which are pivotally attached to the blade in the handle region respectively, and are further pivotally attached to one another and positionally confined to a surface defining slot within the finger guard.

17. The folding knife as recited in claim 12 where the extractable finger guard is positioned above lower contour of the blade in the transverse direction while the knife is in a closed orientation.

18. The folding knife as recited in claim 16 where the extractable finger guard is positioned within a profile of the lower perimeter region of the handle region when the extractable finger guard is in a closed position.

19. The folding knife as recited in claim 12 where the actuating system is comprised of a center gear that is attached to the blade and the center gear is gearingly attached to a second gear, the center gear having an upper finger guard attached thereto and the second gear having the extractable finger guard attached thereto where the gear count of the center gear is less than the gear count of the second gear.

20. The folding knife as recited in claim 19 where the gear ratio from the center gear to the second gear is 1 to 2.

21. The folding knife as recited in claim 12 where a second extractable finger guard is generally attached to the folding knife and the actuating system repositions the second extractable finger guard from a closed position to an open position when the blade is repositioned from a close orientation to an open orientation.

22. The folding knife as recited in claim 21 where the extractable finger guard and the second extractable finger guard both travel in a positive direction from the closed position to the open position.

23. The folding knife as recited in claim 21 where the second extractable finger guard rotates in a negative rotational direction from the closed position to the open position and the extractable finger guard travels in a positive rotational direction from the closed orientation to the open orientation.

24. The folding knife as recited in claim 6 whereby a second gear is attached to a second finger guard whereby the second gear is gearingly attached to the knife gear to rotate from a retained position to an extended position whereby when the second finger guard is in a retained position, a second trailing edge surface of the second finger guard is retained behind an upper portion of the lateral profile of the handle.

25. The folding knife as recited in claim 24 where the second gear is attached to the blade and adapted to rotate therewith and the first gear is in communication and is gearingly connected to the second gear where the ratio from the first gear to the second gear is 1 to 2.

26. A finger guard assembly attached to a knife having a handle region and a blade where the blade is pivotally attached to the handle region at a forward location, the finger guard comprising:

a) a pivot attachment region pivotally mounted to the handle at the forward location, the finger guard having a first orientation where an elongate portion of the finger guard is positioned adjacent to the handle in a retracted position, and the finger guard has a second position extending in a transverse direction with respect to the handle, b) whereas the finger guard extends from the first position to the second position when the blade reorientates from a closed orientation to an open orientation.

27. The finger guard as recited in claim 26, where the finger guard is positioned from the first position to the second position by way of the movement of the blade with respect to the handle by an actuating means.

28. The finger guard as recited in claim 27 where the blade and the finger guard show a common center axis of rotation.

* * * * *